US006218652B1

(12) United States Patent
Kim et al.

(10) Patent No.: US 6,218,652 B1
(45) Date of Patent: Apr. 17, 2001

(54) APPARATUS FOR ELIMINATING INRUSH CURRENT OF A MICROWAVE OVEN

(75) Inventors: Cheol-jin Kim; Won-woo Choi, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/387,561

(22) Filed: Sep. 1, 1999

(30) Foreign Application Priority Data

May 29, 1999 (KR) ..... 99-19599
May 29, 1999 (KR) ..... 99-19600

(51) Int. Cl.[7] ..... H05B 6/68
(52) U.S. Cl. ..... 219/721; 219/505; 307/135
(58) Field of Search ..... 219/715–721, 219/505, 723

(56) References Cited

U.S. PATENT DOCUMENTS 4,011,427 * 3/1977 Risman ..... 219/716
4,321,447 * 3/1982 Lamb ..... 219/721
4,375,587 * 3/1983 Perl ..... 219/721
4,982,063 * 1/1991 Tsunekawa et al. ..... 219/721

* cited by examiner

*Primary Examiner*—Teresa Walberg
*Assistant Examiner*—Jeffrey Pwu
(74) *Attorney, Agent, or Firm*—Robert E. Bushnell, Esq.

(57) ABSTRACT

In the microwave oven having a high voltage driving part with a high voltage transformer, a switching unit applies electric power to the high voltage driving part. In the switching unit, when switched on, an operational contact firstly comes in contact with a first contact coupled with a PTC thermistor and secondly with a second contact after a given time period, and a driving unit generates driving force and turns on/off the switching unit. Since the switching unit and driving unit may be simply installed to effectively eliminate the inrush current, assembly and work efficiencies are improved according to a simpler wiring process, and also, the total manufacturing cost for the microwave oven is reduced.

16 Claims, 10 Drawing Sheets

APPARATUS FOR ELIMINATING INRUSH CURRENT OF A MICROWAVE OVEN

CLAIM OF PRIORITY

This application makes reference to, incorporates the same herein, and claims all benefits accruing under 35 U.S.C. §119 from an application for APPARATUS FOR ELIMINATING INRUSH CURRENT OF A MICROWAVE OVEN earlier filed in the Korean Industrial Property Office on the 29th of May 1999 and there duly assigned Ser. Nos. 19599/1999 and 19600/1999.

BACKGROUND OF THE INVENTION

1. Field of the Invention

The present invention relates to a microwave oven, and more particularly, to an apparatus for eliminating inrush current in an application of initial voltage in a microwave oven.

2. Description of the Prior Art

As well known, a microwave oven is a device for radiating microwave generated from a magnetron to a foodstuff safely placed in a cooking chamber and cooking the foodstuff by fictional heat generated by an inner molecular movement. This microwave oven is generally classified into two types; an electronic type using a microcomputer and a mechanical type using a timer.

FIG. 1 is a disassembled perspective view of a conventional electronic type microwave oven. Referring to FIG. 1, in the aspect of its structure, the conventional microwave oven 10 is roughly composed of a controlling part 20, a high voltage driving part 30 and a heating part 40.

The controlling part 20 has a plurality of buttons 21 for determining the cooking time and the cooking power in the microwave oven, and the plurality of buttons 21 are connected to a printed circuit board (PCB) 6 on the rear side of which a microcomputer 9 and various components are built-in. The microcomputer 9 of the PCB 6 performs the cooking mode by turning on/off the driving status of the microwave oven according to the time and power determined by the respective buttons 21. Further, the controlling part 20 includes a display window 24 for displaying various kinds of cooking times and cooking statuses, and a door lever 25, which will be described later, for opening and closing a door 43.

The high voltage driving part 30 consists of a magnetron MGT for generating microwave, a waveguide (not shown) for guiding the microwave generated from the magnetron MGT to a cooking chamber 41, a high voltage transformer HVT for generating high voltage and pre-heating voltage needed for the driving of the magnetron MGT, a cooling fan 3 for cooling the high voltage transformer HVT, a high voltage capacitor HVC, a high voltage diode HVD, and the magnetron MGT, and a lamp 2 for lighting the cooking chamber 41, etc.

The heating part 40 consists of the cooking chamber 41 as a closed space, a rotary tray 42 on which foodstuffs may be securely placed in the cooking chamber 41, and a door 43 for opening and closing the cooking chamber 41.

FIG. 2 shows the circuit diagram of FIG. 1. As shown in FIG. 2, first and second power lines L1, L2 for receiving general alternating current, AC 220V, are connected with both ends of a primary coil 7*a* of the high voltage transformer HVT via a noise filter 1. This noise filter 1 is composed of a main fuse FUSE 1, capacitors C1 to C3, an inductor L, a resistor R1, etc. A detailed description about operations of the noise filter is herein omitted since it is the same as a general noise filter for cutting off high frequency (HF) transferred to the outside through the power lines L1 and L2.

The first power line L1 is connected in series with a magnetron temperature sensor TCO1 which is turned on/off according to the temperature of the magnetron MGT to prevent overheating of the magnetron, a first door switch SW1 which is turned on/off according to the opening or closing status of the door 43, and a monitor switch $SW_{MT}$ for monitoring the opening or the closing state of the door 43.

The second power line L2 is connected in series with a cooking chamber temperature sensor TCO2 which is turned on/off according to the temperature of the cooking chamber 41 to prevent the overheating of the cooking chamber 41, and a power relay RY3 for turning on/off main power. The power relay RY3 is also connected in parallel with an inrush relay RY2 for eliminating inrush current. The inrush switch $SW_{IR}$ is connected to a resistor R2 for restricting the current, wherein the resistor R2 for current restriction is generally a cement resistor having a high resistance capability.

The power relay RY3 and the inrush relay RY2 constitute respective relay elements, together with individual coils, respectively. The power relay RY3 and the inrush relay RY2 are turned on/off by the respective relay coil which is disposed on the PCB 6 and controlled by the microcomputer 9.

At this time, the inrush relay RY2 is firstly turned on by a control of the microcomputer 9, and after a given time period, e.g., 20–40 ms, the power relay RY3 is operated. Therefore, after an application of initial power, the inrush current of high reverse-electromotive force generated by the high voltage transformer HVT is consumed by the current restriction resistor R2 and the inrush relay RY2, and then, the power relay RY3 is turned on, to thereby prevent an overload of each driving circuit and damage to the microwave oven.

For the operation of the microwave, the microcomputer 9 turns on the main relay RY4, the inrush relay RY2 and the power relay RY3 through the respective coils arranged on the PCB 6. Accordingly, the main relay RY4 is turned on, and the lamp 2, the fan motor 3 and the driving motor 4 of the microwave oven are operated. Further, as the inrush relay RY2 and the power relay RY3 are sequentially turned on, voltage is generated by the high voltage driving part 30, and the magnetron MGT of the high voltage driving part 30 generates the microwave for cooking foodstuff placed in the cooking chamber 41.

Meanwhile, the heater is operated by the same operation of the above components, except that the microcomputer 9 turns off the inrush relay RY2 and the power relay RY3, while turning on the heater relay RY1, to operate the heater 8 instead of the magnetron MGT so that the grill cooking is performed.

FIG. 3 is a disassembled perspective view of a conventional mechanical type microwave oven. In FIG. 3, in its structural aspect, a conventional microwave oven 10 may be roughly divided into a controlling part 20', a high voltage driving part 30, and a heating part 40, which is the same as in the above-mentioned electronic type. The difference of the mechanical type microwave oven from the electronics type is that the controlling part 20' is composed of respective time control knob 21 and power control knob 22 for determining each of the cooking time and cooking power of the microwave oven. Each of knobs 21 and 22 is connected to a timer 23 placed on its rear side. Due to the timer 23 which turns on or off the driving status of the microwave oven according to the time and the power determined by each of the knobs 21 and 22, the microwave oven performs a cooking operation properly. Further, the controlling part 20' also includes a display window 24 for displaying various cooking times and statuses, and a door lever 25 for opening or closing the door 43, which will be described later.

FIG. 4 is the circuit diagram of FIG. 3. As shown in FIG. 4, the first and second power lines L1 and L2 for receiving the general alternating current, AC 220V, are connected with both ends of the primary coil 7*a* of the high voltage transformer HVT via the noise filter 1. The noise filter 1 is composed of the main fuse FUSE 1, the capacitors C1 to C3, the inductor L, the resistor R1, etc. The detailed description about operations of the noise filter will be omitted since it is the same as a general noise filter used for cutting off the high frequency (HF) transferred to the outside through the power lines L1 and L2.

The first power line L1 is connected in series with the magnetron temperature sensor TCO1 which is turned on/off according to the temperature of the magnetron MGT to prevent overheating of the magnetron, the first door switch SW1 which is turned on/off according to the opening or closing status of the door, a power controlling switch $SW_{VP}$ for controlling the power of the microwave, and the monitor switch $SW_{MT}$ for monitoring the opening or the closing state of the door 43.

The second power line L2 is connected in series with the cooking chamber temperature sensor TCO2 which is turned on/off according to the temperature of the cooking chamber 41 to prevent the overheating of the cooking chamber 41, the second door switch SW2 which is turned on/off according to the opening or closing status of the door, a time switch $SW_{TM}$ for controlling the cooking time of cooking, and the inrush switch $SW_{IR}$ for removing the inrush current.

The other side of the monitor switch $SW_{MT}$, one side of which is connected to the primary coil 7*a* of the high voltage transformer HVT, is connected to the second door switch SW2 through the monitor fuse FUSE2. The monitor switch $SW_{MT}$ is also connected in parallel with the inrush coil 6*a* for turning on/off the inrush switch $SW_{IR}$. The inrush switch $SW_{IR}$ and the inrush coil 6*a* are constructed in one relay 6, and it does not operate immediately upon application of outside voltage, but operates after a lapse of a time period, e.g., 20–40 ms, based on its operating characteristic. The inrush switch $SW_{IR}$ is also connected in parallel with the resistor R2 for a current restriction, wherein the resistor R2 for current restriction is generally a cement resistor having high resistance capability.

Thus, when power is applied to the inrush coil 6*b* in an on-state of the monitor switch $SW_{MT}$, the relay 6 turns on the inrush switch $SW_{IR}$ after a lapse of the time period based on its operational characteristic described above. Accordingly, immediately after an application of the initial power, the inrush current of a high reverse-electromotive force generated by the high voltage transformer HVT is consumed by the current restriction resistor R2, and then, the inrush switch $SW_{IR}$ is turned on, to thereby prevent overloading each driving circuit and any damage to the microwave oven.

The lamp 2, the fan motor 3, the driving motor 4 and a timer motor 5 are connected between the first power line L1 and the second power line L2. The lamp 2, the fan motor 3 and the timer motor 5 are driven generally by the power source voltage, AC 220V, and the driving motor 4 is driven by the low voltage, about AC 21V, supplied from one coil of the fan motor 3.

The time switch $SW_{TM}$, the power controlling switch $SW_{VP}$ and timer motor 5 are housed in one body inside the timer 23.

As mentioned above, conventional microwave ovens of the electronic and mechanical types are very useful instruments, which accurately drive the high voltage driving part 30 in the time a user wants for respective foodstuff to be cooked and eliminates the inrush current upon an application of the initial voltage.

However, as mentioned above, the conventional electronic type microwave oven requires a plurality of expensive relays to eliminate any inrush current, and also requires some complicated microcomputer control technique to connect the individual relays in due sequence. Further, the overall manufacturing cost for the electronic type microwave oven and the mechanical type microwave oven increases due to an expensive relay which is required for an effective operation of the timer, and due to the very complicated relay installation and wiring processes during the manufacturing process.

SUMMARY OF THE INVENTION

Accordingly, the present invention has been made to solve the above problems, and it is an object of the present invention to provide an apparatus for eliminating the inrush current of a microwave oven, in which the inrush current may be effectively eliminated with a simple construction to thereby reduce manufacturing costs of the microwave oven and simplify its manufacturing process.

To achieve these and other advantages, and in accordance with the purpose of the present invention as embodied and broadly described, in a microwave oven including a high voltage driving part which has a high voltage transformer, an apparatus for eliminating inrush current of the microwave oven includes a switching unit for applying power source voltage to the high voltage driving part in which, when switched on, an operational contact is firstly connected to a first contact coupled with a PTC thermistor at one end of the first contact, and, after a given time period, is secondly connected to a second contact, and a driving unit for turning on/off the switching unit by generating a driving force.

The switching unit consists of a first fixation plate one end of which is fixed and connected to a first terminal via a PTC thermistor and at the other end of which the first contact is formed; a second fixation plate one end of which is fixed and connected to the fist terminal and at the other end of which the second contact is formed at a given distance from the first contact; and an operating plate one end of which is fixed and has a second terminal, and at the other end of which an operating contact is formed to be sequentially connected to the first and the second contacts by the driving force of the driving unit.

The driving unit is a relay operating part for operating the switching unit by a magnetic force generated by a control of the microcomputer.

The relay operating part includes a relay coil for generating the magnetic force due to electric current turned on by the microcomputer; and a push member for pushing the operating plate by being rotated with respect to a hinge by the magnetic force of the relay coil.

The driving unit is a cam for operating the switching unit by the driving force of the timer motor.

The cam includes a rotary plate having a groove at one side thereof, which is rotated by the driving force of the timer motor. The operating plate includes a projection part inserted into the groove at an initial position of the timer motor wherein the projection part is pushed by the circumferential side of the rotary plate when the rotary plate is rotated out of the initial position.

The distance between the operational contact and the second contact is provided as such that the operational contact is firstly in contact with the first contact and secondly with the second contact after about 20–40 ms.

It is preferable that the distance between the operational contact and the second contact is 2–4 mm farther than the distance between the operational contact and the first contact.

Additional features and advantages of the invention will be set forth in the description which follows, and in part will be apparent from the description, or may be learned by practice of the invention. The objects and other advantages of the invention will be realized and attained by the structure as illustrated in the written description and claims hereof, as well as the appended drawings.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
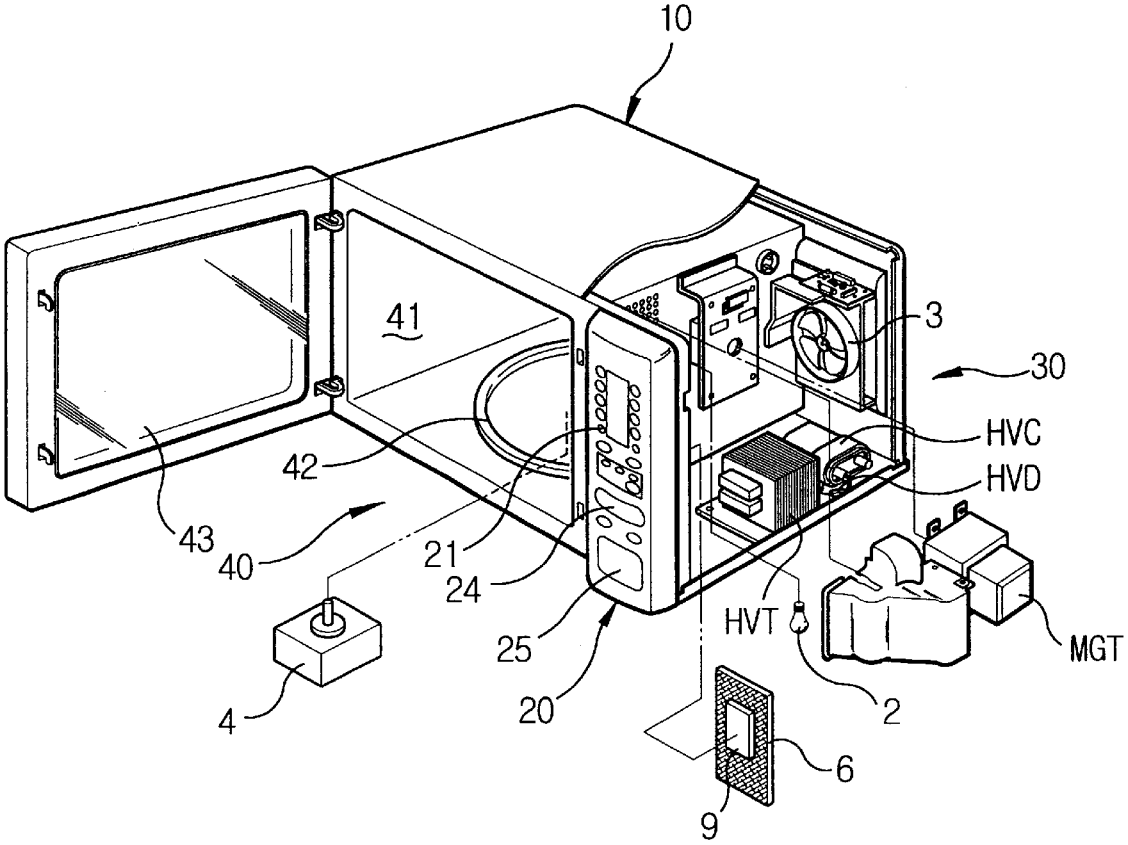
FIG. 1 (PRIOR ART)
FIG. 1 shows a disassembled perspective view of a conventional electronic type microwave oven.

Reference will now be made in detail to the preferred embodiments of the present invention, examples of which are illustrated in the accompanied drawings.

In the invention, the same reference numerals are applied to the same components throughout the description.

Figure 5:
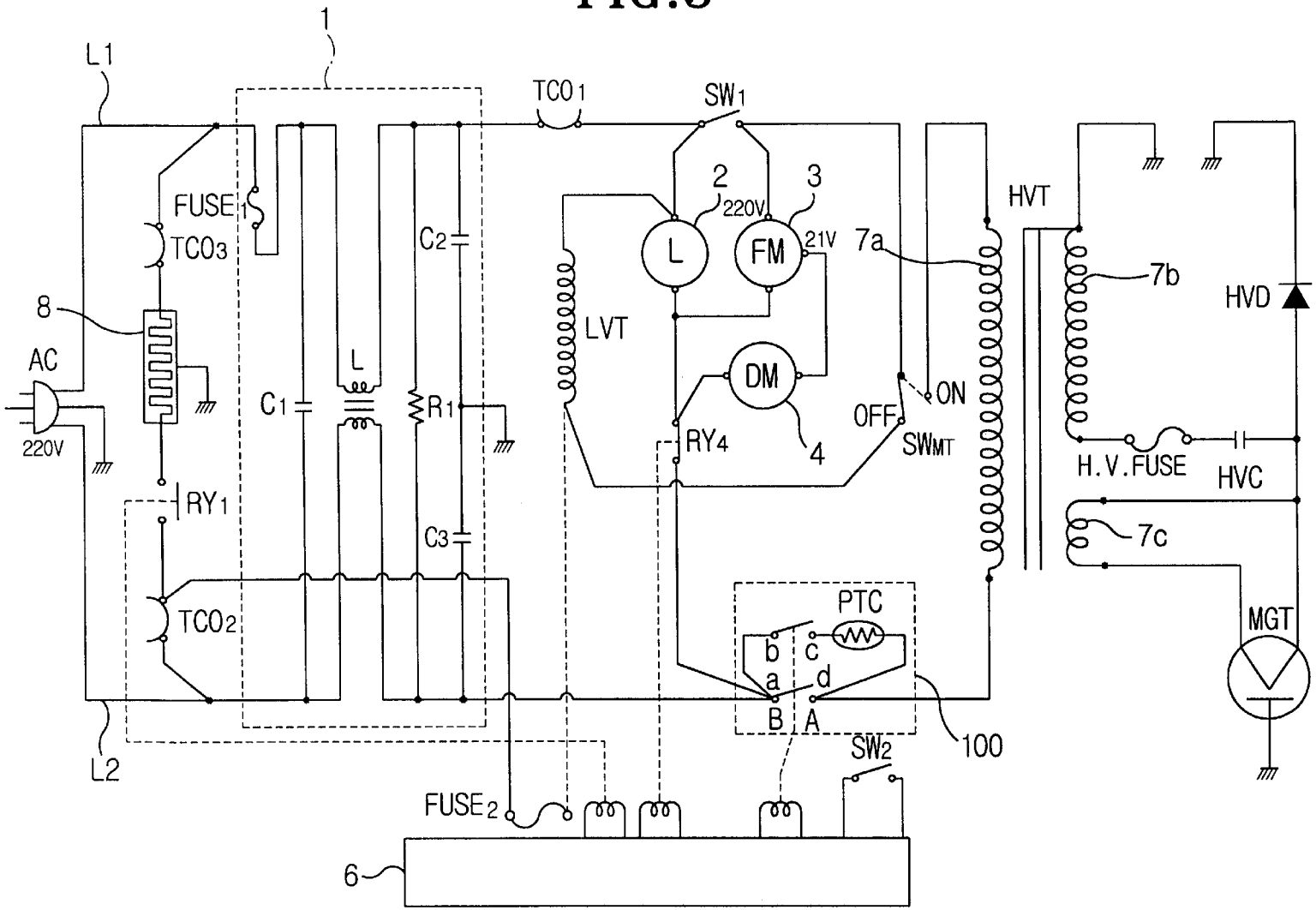
FIG. 5 is a circuit diagram of an apparatus for eliminating inrush current of a microwave oven according to an embodiment of the present invention.

FIG. 5 is a circuit diagram for showing an apparatus for eliminating the inrush current of an electronic type microwave oven according to an embodiment of the present invention.

As shown in FIG. 5, first and second power lines L1 and L2 for receiving general alternating current voltage of AC 220V, are connected with both ends of a primary coil 7*a* of the high voltage transformer HVT via a noise filter. The first power line L1 is connected in series with a magnetron temperature sensor TCO1 which is turned on/off according to the temperature of the magnetron MGT to prevent any overheating of the magnetron MGT, a first door switch SW1 which is turned on/off according to an opening or a closing state of the door 43, and a monitor switch $SW_{MT}$ for monitoring the opening or the closing state of the door 43.

The second power line L2 is connected to a cooking chamber temperature sensor TCO2, which is turned on/off according to the temperature of the cooking chamber 41, to prevent the overheating of the cooking chamber 41.

A heater 8 is connected between the first power line L1 and the second power line L2 before the noise filter 1, and is also connected in series with a heater relay RY1 for turning on/off the heater 8 and a heater temperature sensor TCO3 for preventing the overheating of the heater 8. The lamp 2, a fan motor 3, a driving motor 4, and a low voltage transformer LVT are connected between the first power line L1 and the second power line L2 and placed on the rear stage of the noise filter 1, and a main relay RY4 for ting on/off the lamp 2, the fan motor 3 and the driving motor 4, is also connected therebetween. The low voltage transformer LVT lowers the power source voltage, and then supplies the direct current (DC) voltage to the PCB 6 through a rectification unit (not shown).

Various circuit elements driven by the DC voltage are disposed together with the microcomputer 9 shown in FIG. 1, on the PCB 6. The heater relay RY1 and the main relay RY4 constitute individual relay elements with individual coils, and are turned on/off by each relay coil disposed on the PCB 6 and controlled by the microcomputer 9 (See FIG. 1).

The other side of the monitor switch $SW_{MT}$, one side of which is connected to the primary coil 7*a* of the high voltage transformer HVT, is connected to the cooking chamber temperature sensor TCO2 via one side of the low voltage transformer LVT and a monitor fuse FUSE2.

The monitor fuse FUSE2 is placed on the PCB 6, on which a second door switch SW2 is also arranged to be turned on/off according to an opening or a closing status of the door 43. The second door switch SW2 transfers the opening or the closing status of the door 43 to the microcomputer 9.

Figure 2:
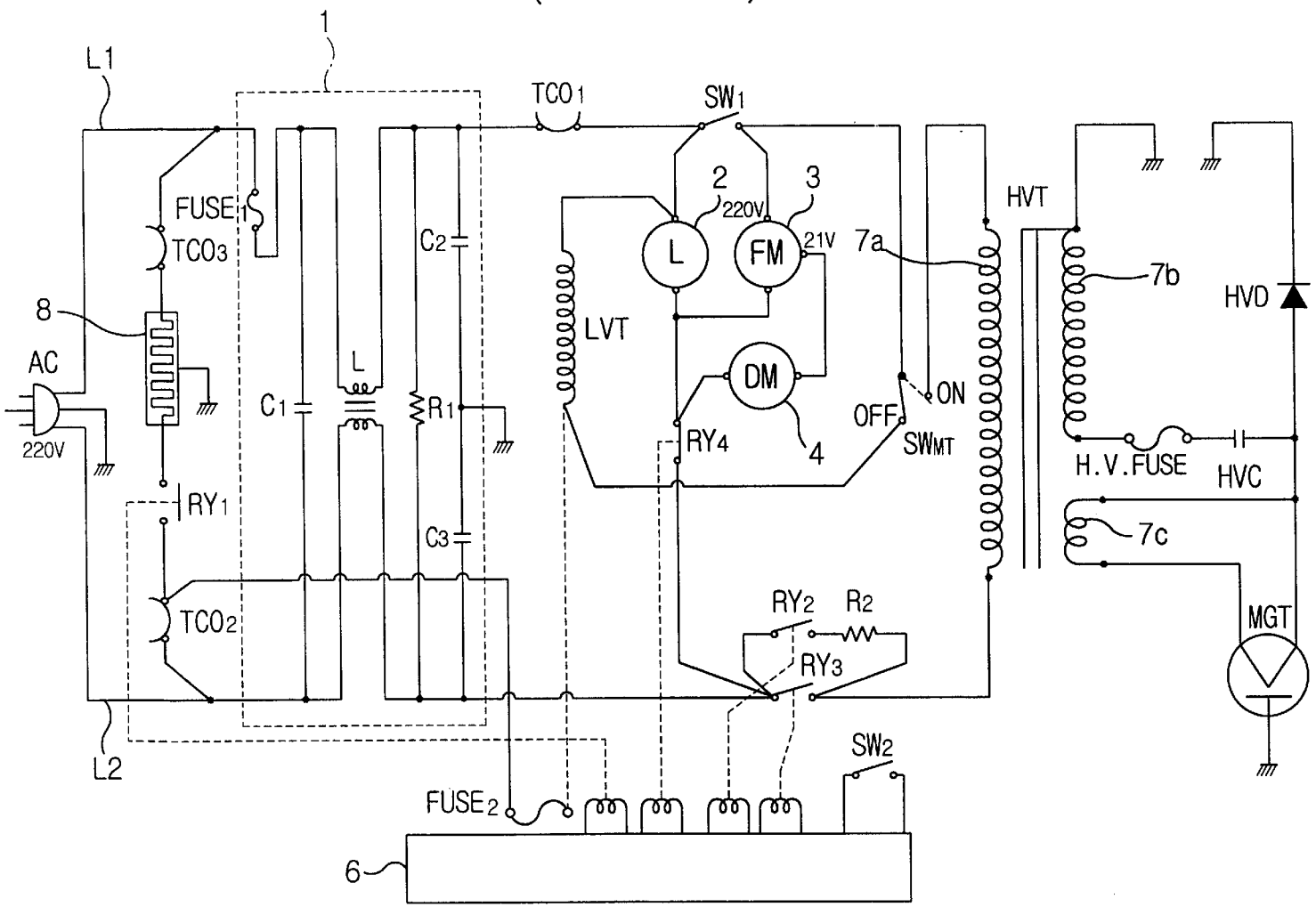
FIG.2 (PRIOR ART)
FIG. 2 is a circuit diagram of FIG. 1.

Since above construction is the same as that explained by the prior art of FIGS. 1 and 2, its detailed description will be omitted.

Now, the main principal characteristic of the present invention will be described. A switching unit 100 for controlling the application status of power voltage and also for eliminating the inrush current, is placed between the power line L2 connected to the cooking chamber temperature sensor TCO2 and the primary coil 7*c* of the high voltage transformer HVT.

The switching unit 100 is firstly connected, when switched on, to the first contact c at one end of which the operational contacts are connected to the PTC thermistor PTC, and is secondly contacted with the second contact after a given time period, to thereby apply the power source voltage to the high voltage driving part 30. Further, the switching unit 100 is turned on/off by a driving unit 120 which will be described later.

Figure 6:
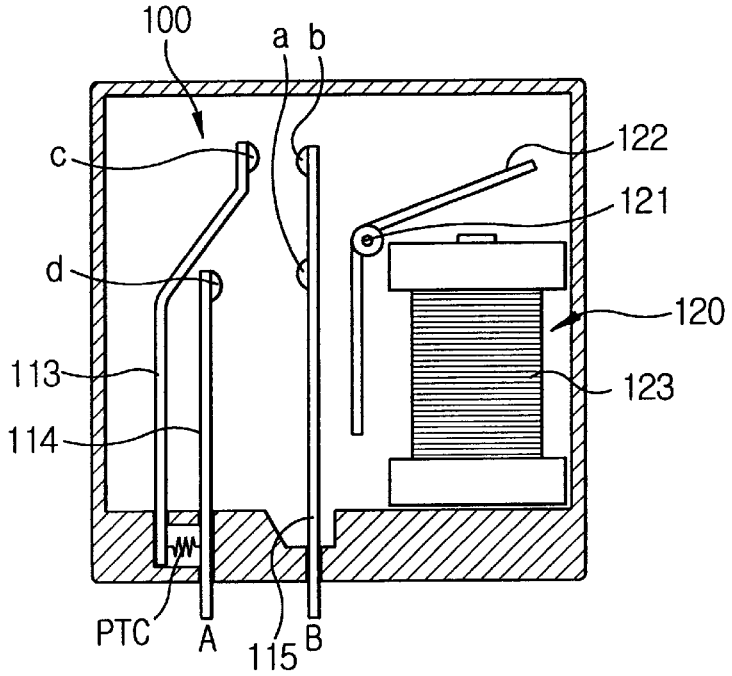
FIGS. 6 to 8 are views for showing detailed operational status of a switching unit and a driving unit shown in FIG. 5.
Figure 7:
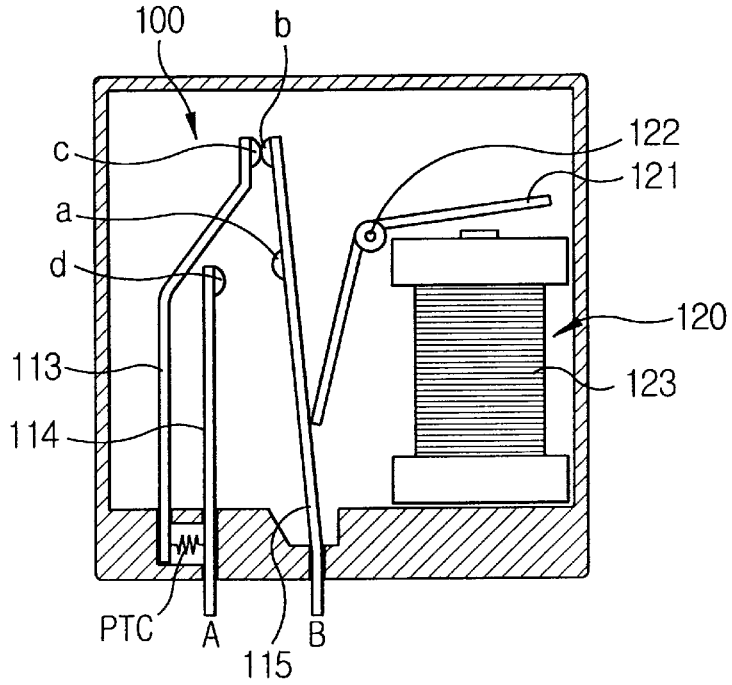
Figure 8:
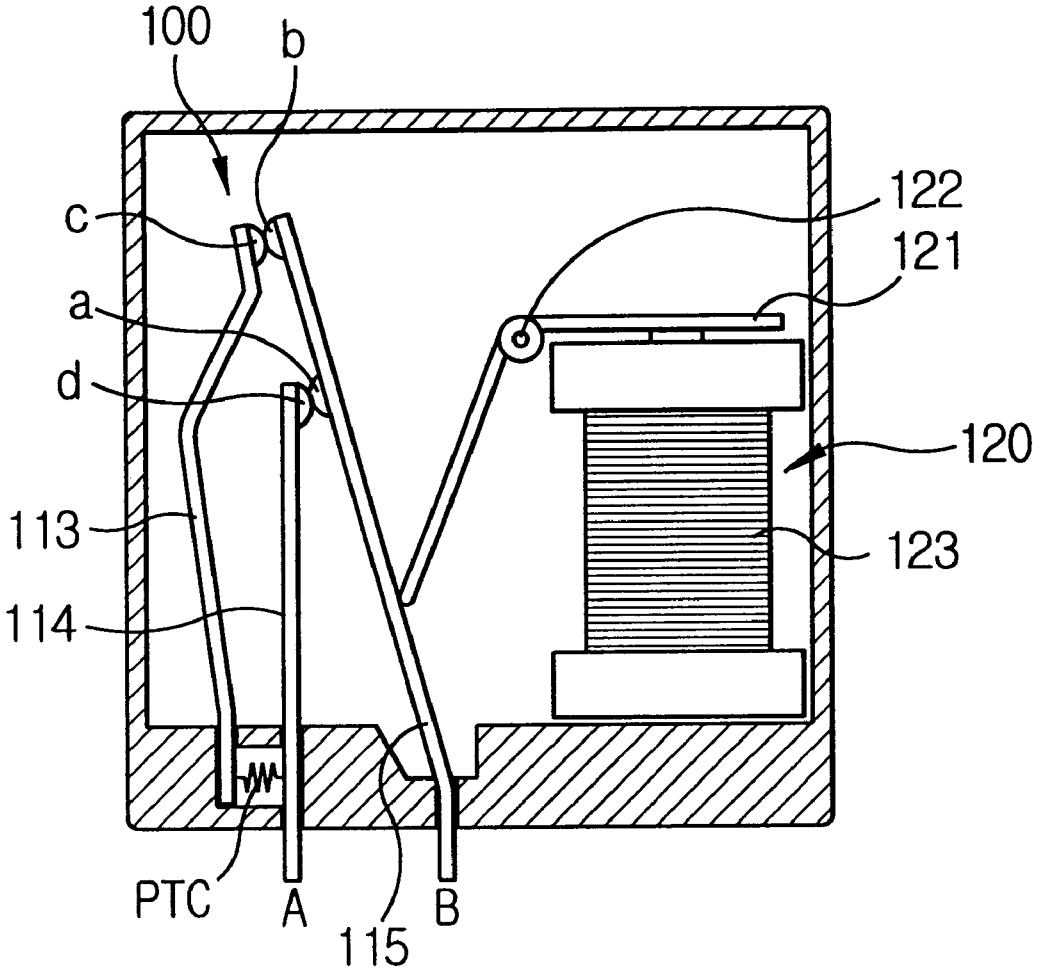

FIGS. 6 to 8 show the operation statuses for the driving unit and the switching unit according to an embodiment of the present invention in detail, including such a PTC thermistor.

The positive temperature coefficient thermistor (PTC thermistor) means a positive characteristic thermistor remarkably increasing its resistance value according to the rise in temperature, different from that of a general negative characteristic thermistor.

As shown in the FIGS. 6 to 8, the switching unit 100 is composed of a first fixation plate 113 one end of which is fixed and connected to a first terminal A via the PTC thermistor PTC and at the other end of which the first contact c is formed; a second fixation plate 114 one end of which is fixed and connected to the first terminal A and at the other end of which the second contact d is formed in a given distance from the first contact c; and an operating plate 115 one end of which is fixed, at the one end of which the second terminal B is formed, and at the other end of which the operational contacts a and b are formed which are sequentially in contact with the first contact c and the second contact d by the driving force of the driving unit 120.

The driving unit 120 is a relay operating part for operating the switching unit 100 by a magnetic force generated by a control of the microcomputer 9. The relay operating part includes a relay coil 123 for generating the magnetic force by electric current under the control of the microcomputer 9, and a push member 121 which is rotated with respect to a hinge part 122 by the magnetic force of the relay coil 123 to press the operating plate 115.

The operation of the electronic microwave oven with such construction according to an embodiment of the present invention is described in detail as follows:

Foodstuff is safely placed in a cooking chamber 41 and a door 43 is closed. First and second door switches SW1 and SW2 and a monitor switch $SW_{MT}$ are turned on, so that the microwave oven becomes ready for operation.

Under the above state, when a user presses an operational button 21 for the sake of the execution of a cooking function of the microwave oven, the microcomputer 9 turns on the main relay RY4 through each coil arranged on the PCB 6, and also turns on the switching unit 100 by operating the driving unit 120.

Therefore, a contact of the main relay RY4 is turned on, and the lamp 2, the fan motor 3 and the driving motor 4 of the microwave oven are operated. Further, immediately after an application of initial electric power, the inrush current due to a high reverse-electromotive force generated by the primary coil 7*a* of the high voltage transformer HVT is consumed by the PTC thermistor PTC, and then the microwave oven operates normally.

In greater detail, as shown in FIGS. 6 to 8, the second terminal B of the operating plate 115 in the switching unit 100 is connected to an input side of the power line L2. The first terminal A of the first and second fixation plates 113 and 114 is connected to the power line L2 of one side of the primary coil 7*a* of the high voltage transformer HVT. Further, the first contact c of the first fixation plate 113 and the second contact d of the second fixation plate 114 are kept at a different distance from the operational contacts a and b of the operating plate 115. More specifically, the second contact d is placed about 2~4 mm farther from the operational contacts a and b than the first contact c.

In this state, as electric current flows into the relay coil 123 of the driving unit 120 by the microcomputer 9, the magnetic force is generated around the relay coil 123. The push member 122 is rotated with respect to the hinge part 121 by the magnetic force. Accordingly, the operating plate 115 moves toward the first and second fixation plates 113 and 114, and the operational contacts a and b come in contact with the first contact c and with the second contact d, sequentially.

Accordingly, immediately after an application of the initial electric power, the inrush current of a high reverse-electromotive force generated in the primary coil 7*a* of the high voltage transformer HVT is eliminated through the PTC thermistor PTC positioned on one side of the first contact c. Then the second contact d comes in contact-state after the lapse of a given time period, e.g., 20–40 ms due to difference of distance of 2–4 mm between the respective contacts, to thereby prevent any damage to the microwave oven and an overload of each driving circuit.

Then, normal driving power is provided to the microwave oven by the above operations, and the lamp 2, the fan motor 3 and the driving motor 4 are operated as described above. The high voltage transformer HVT also generates high voltage, and the high voltage is supplied to the magnetron MGT through each of the high voltage capacitor HVC and the high voltage diode HVD. Accordingly,the magnetron MGT is driven to generate the microwave to cook any foodstuff placed inside the cooking chamber 41.

Figure 9:
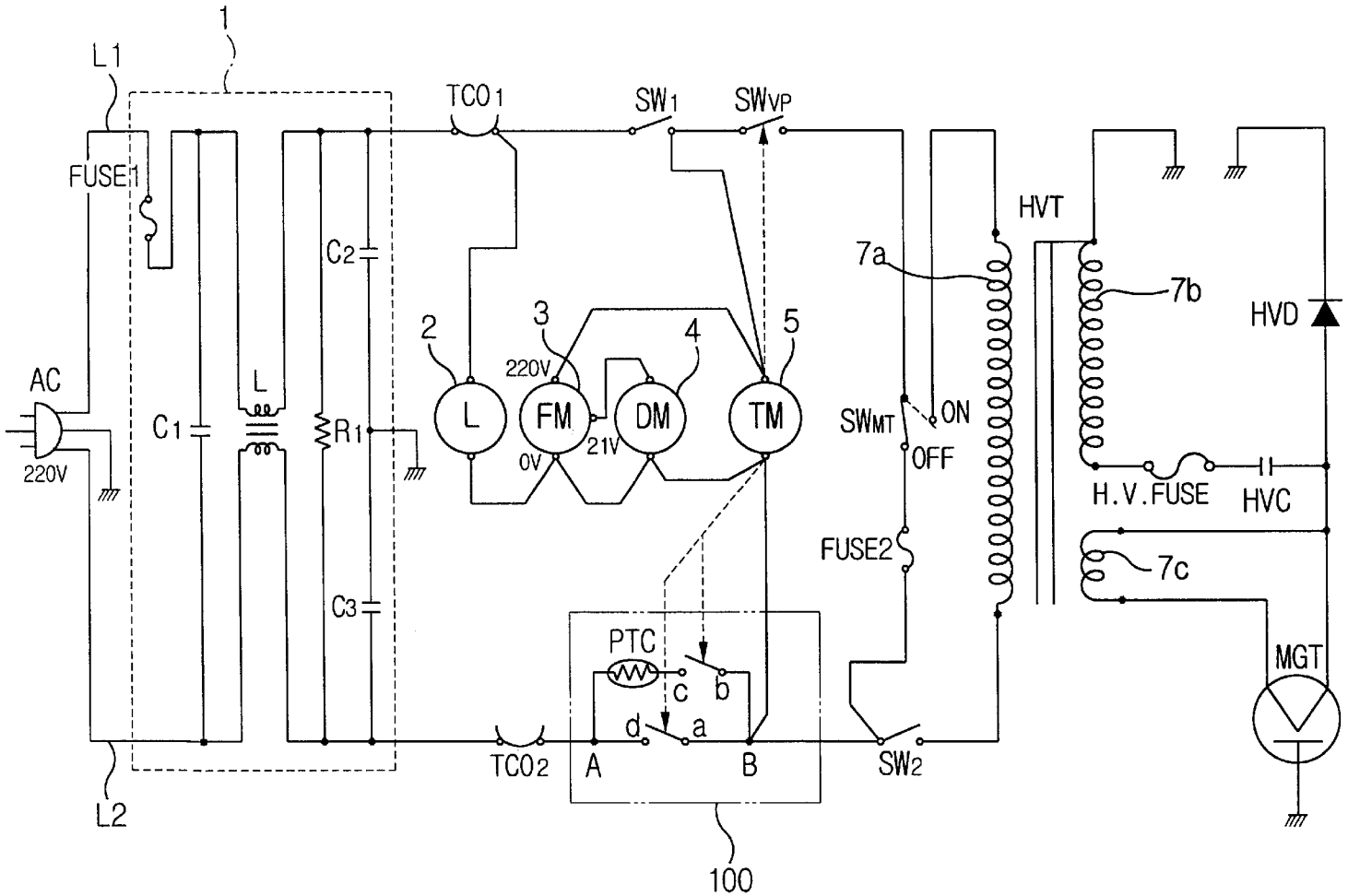
FIG. 9 is a circuit diagram of an apparatus for eliminating the inrush current of a mechanical type microwave oven according to an embodiment of the present invention.

FIG. 9 is a circuit for showing an apparatus for eliminating the inrush current of the mechanical type microwave oven according to an embodiment of the present invention.

As shown in FIG. 9, the first and second electric power lines L1 and L2 for receiving general alternating current of AC 220V, are connected with both ends of a primary coil 7*a* of the high voltage transformer HVT via a noise filter 1. The first electric power line L1 is connected in series with a magnetron temperature sensor TCO1 which is turned on/off according to a temperature of the magnetron MGT to prevent any overheating of the magnetron MGT, a first door switch SW1 which is turned on/off according to the opening or closing status of the door 43, a power controlling switch $SW_{VP}$ for controlling a power of the microwave, and a monitor switch $SW_{MT}$. Further, the second electric power line L2 is connected to a cooking chamber temperature sensor TCO2 which is turned on/off according to the temperature of the cooking chamber 41 to prevent the overheating of the cooking chamber 41, and a second door switch SW2 which is turned on/off according to the opening or closing status of the door. The lamp 2, a fan motor 3, a driving motor 4 and a timer motor 5 are connected between the first electric power line L1 and the second electric power line L2.

Figure 3:
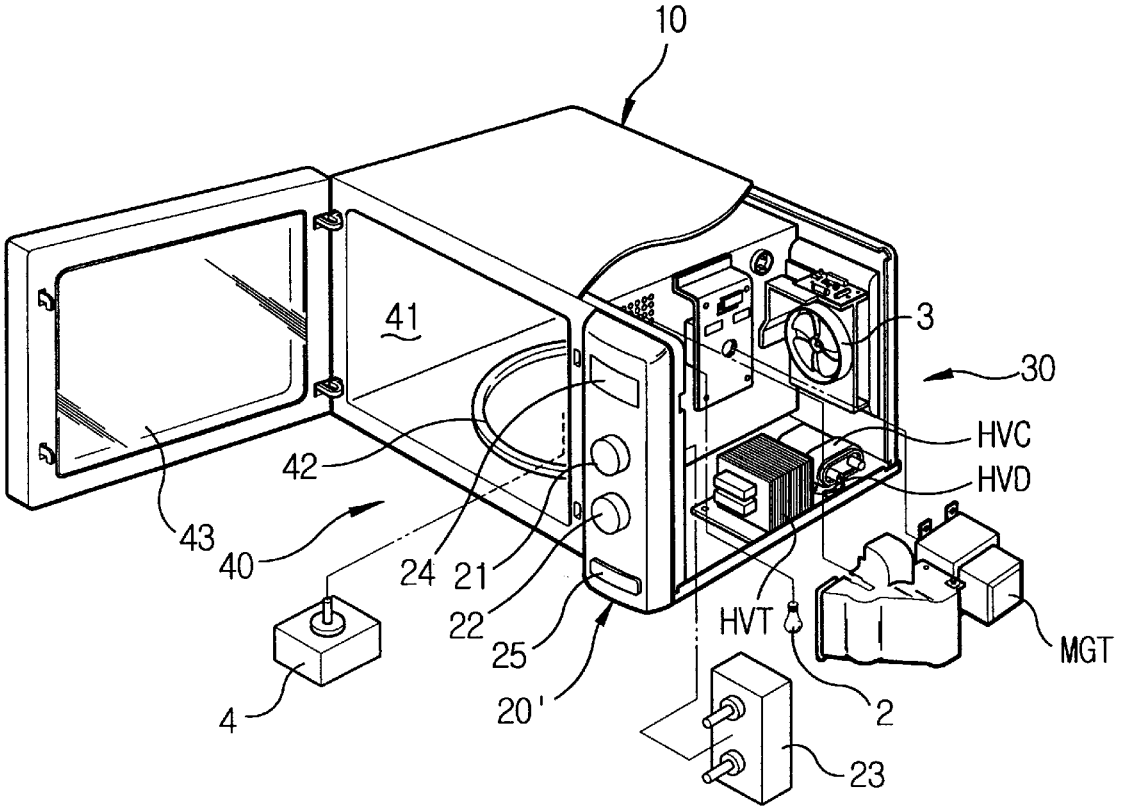
FIG.3 (PRIOR ART)
FIG. 3 is a disassembled perspective view of a conventional mechanical type microwave oven.
Figure 4:
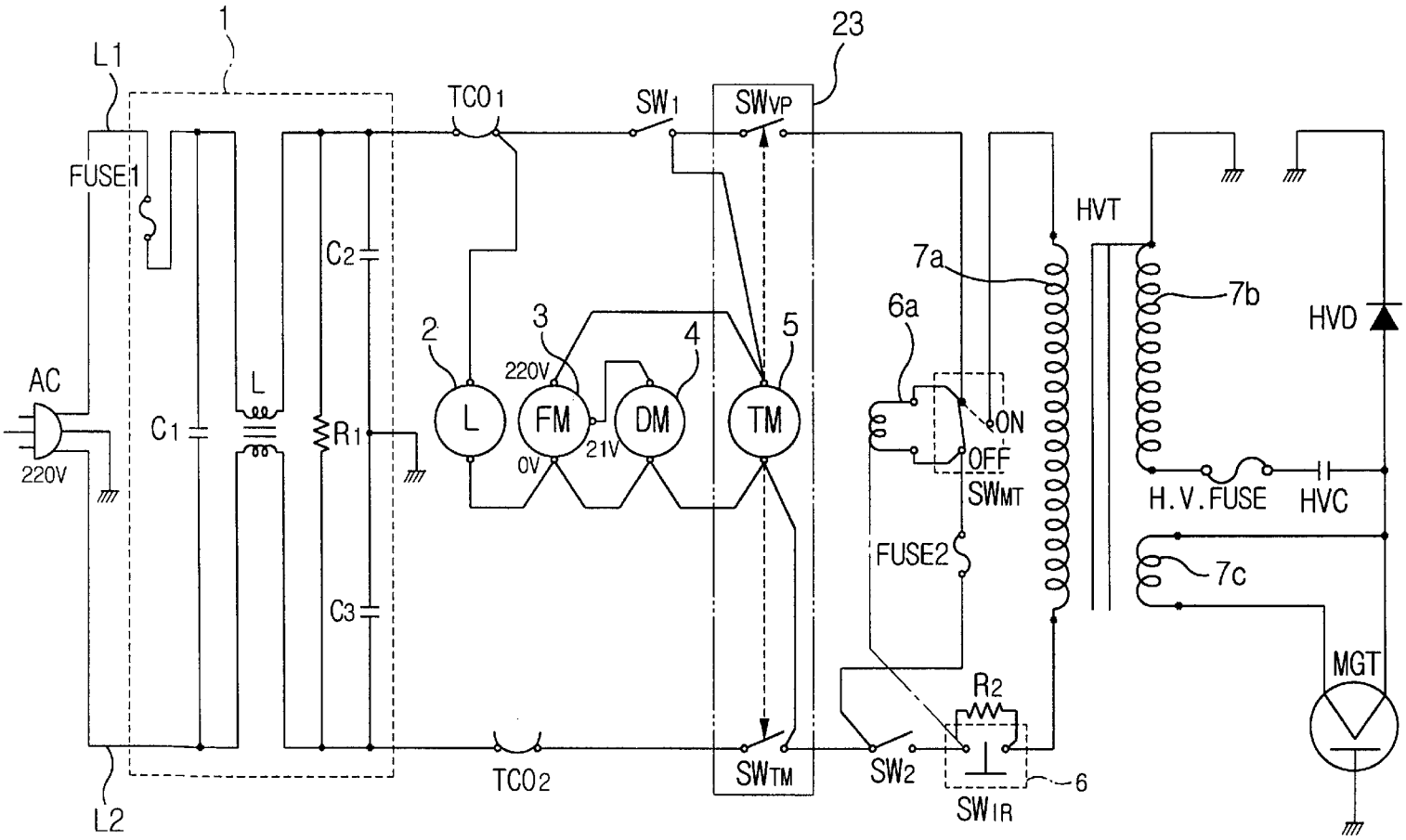
FIG.4 (PRIOR ART)
FIG. 4 is a circuit diagram of FIG. 3.

The above construction is the same as that explained by the prior art in FIGS. 3 and 4, thus its detailed description will be omitted.

Now, an inventive principal characteristic of the present invention will be described. The switching unit 100 is disposed to control an application state of power source voltage and to eliminate the inrush current, between the electric power line L2 connected to the cooking chamber temperature sensor TCO2 and the primary coil 7*c* of the high voltage transformer HVT. When the switching unit 100 is switched on, the operational contacts a and b firstly come in contact with the first contact c to which the PTC thermistor PTC is connected, and then after a given time period, in contact with the second contact d, to thereby apply the electric power voltage to the high voltage driving part 30. Further, the switching unit 100 is turned on/off by the driving unit 120 which will be described later.

Figure 10:
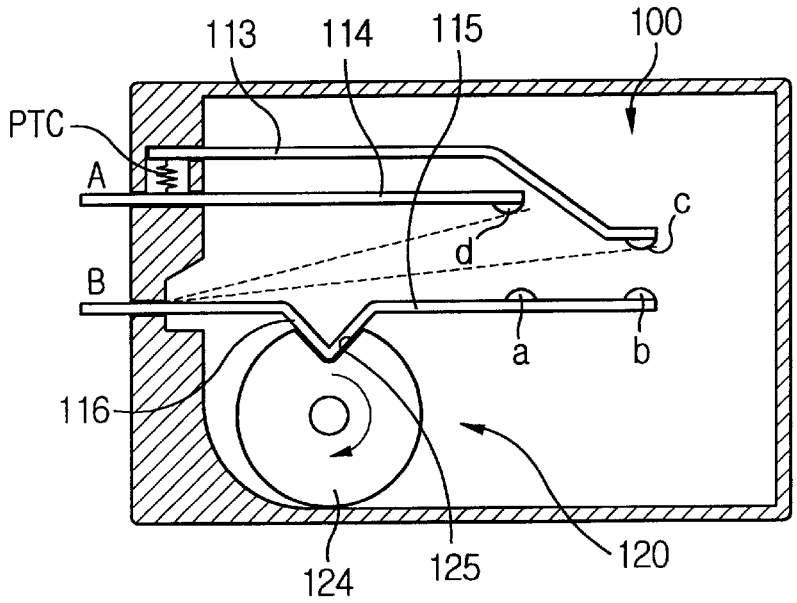
FIGS. 10 to 12 are views for showing detailed operational status of a switching unit and a driving unit shown in FIG. 9.
Figure 11:
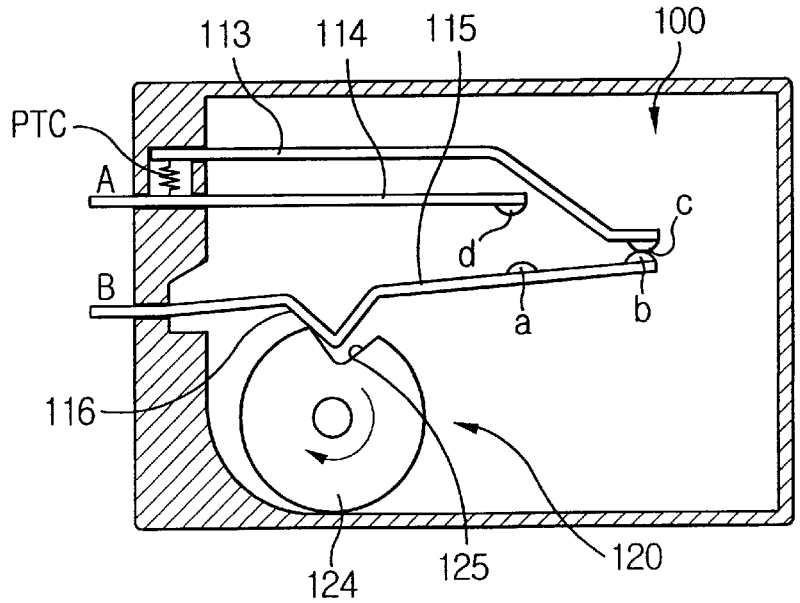
Figure 12:
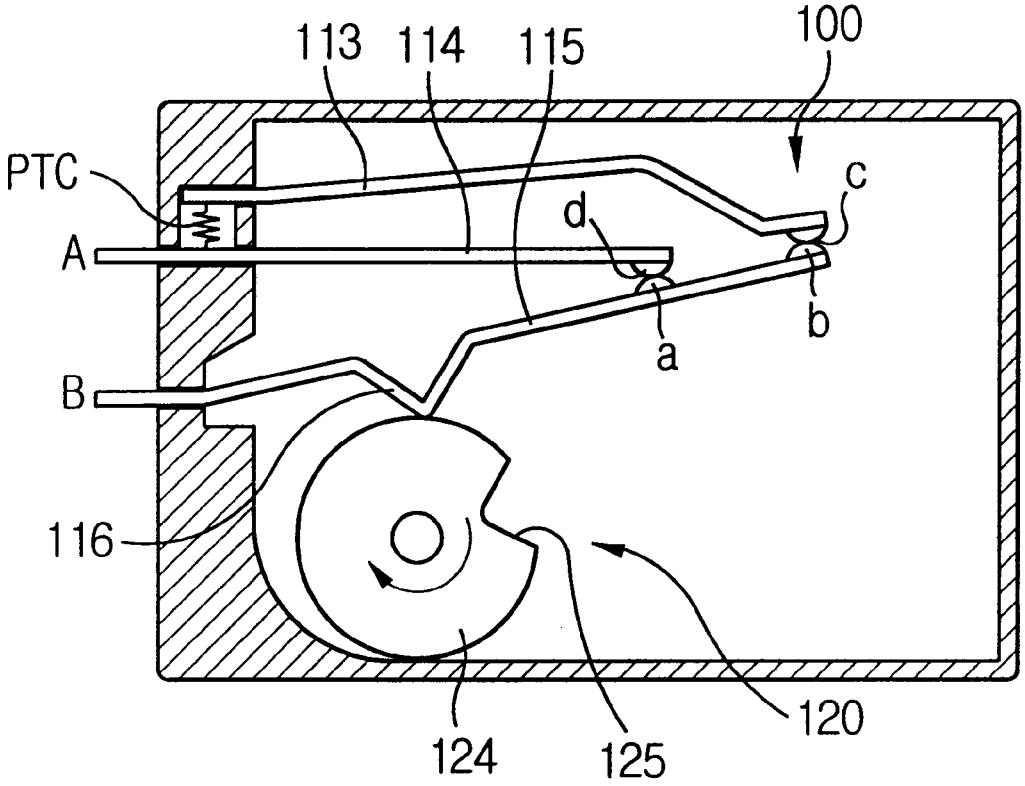

FIGS. 10 to 12 show in detail the structure and its operations for the time switch according to an embodiment of the present invention, including such PTC thermistor.

As shown in FIGS. 10 to 12, the switching unit 100 is composed of a first fixation plate 113 one end of which is fixed and connected to a first terminal A via the PTC thermistor PTC and at the other end of which the first contact c is formed; a second fixation plate 114 one end of which is fixed and connected to the first terminal A and at the other end of which the second contact d is formed at a given distance from the first contact c; and an operating plate 115 one end of which is fixed, at the one end of which the second terminal B is formed, and at the other end of which the operational contacts a and b are formed which are sequentially in contact with the first contact c and the second contact d by the driving force of the driving unit 120.

Further, the driving unit 120 is the cam for operating the switching unit 100 by the driving force of the timer motor 5. The cam includes a rotary plate 124 having a groove 125 formed on one side thereof, which is rotated by the driving force of the timer motor 5. The operating plate 115 includes a projection part 116 inserted into the groove 125 of the rotary plate 124 on an initial position of the timer motor 5 wherein the projection part 116 is pushed by the circumferential side of the rotary plate 124 when the rotary plate 124 is rotated out of the initial position.

The distance between the operational contacts a and b and the second contact d is provided as such that the operational contacts a and b are in contact with the first contact c and then with the second contact d after about 20–40 ms.

It is preferable that the respective distances from the operational contacts a and b to the second contact d are 2–4 mm farther than the respective distances from the operational contacts a and b to the first contact c.

In one embodiment of the present invention, the operation of the mechanical microwave oven with such a construction is described in detail as follows: Foodstuff is securely placed in a cooking chamber 41, then a door 43 is closed. First and second door switches SW1 and SW2, and a monitor switch $SW_{MT}$ are turned on, thus the microwave oven becomes ready for operation. In this state, as the user manipulates a time control knob 21 and a power control knob 22, the timer motor 5 is driven by its own rotating force. The timer motor 5 is automatically driven by the user's manipulation of the time control knob 21 and the power control knob 22, to thereby operate the switching unit 100 and the power controlling switch $SW_{VP}$ for a given period of time.

That is, in the switching unit 100, immediately after an application of the initial electric power, the inrush current of a high reverse-electromotive force generated in the primary coil 7*a* of the high voltage transformer HVT is eliminated through the PTC thermistor PTC, so that the microwave oven operates normally.

Describing in greater detail, as shown in the drawings, the second terminal B of the operating plate 115 in the switching unit 100 is connected to the electric power line L2 of the high voltage driving part 30 through the second door switch SW2. Further, the first terminal A of the first and second fixation plates 113 and 114 is connected to the electric power line L2 at an input side of the power voltage, through the cooking chamber temperature sensor TCO2. The first contact c of the first fixation plate 113 and the second contact d of the second fixation plate 114 are kept at a different distance from the operational contacts a and b of the operating plate 115. More specifically, the second contact d is placed 2–4 mm farther away from the operational contacts a and b than that of the first contact c.

Under this state, the rotary plate 124 of the driving unit 120 is rotated by the timer motor 5, and the groove 125 of the rotary plate 124 moves in a rotating direction by a rotating force. On its initial position, the projection part 116, which is inserted into the groove 125, moves along a slant face of the groove 125 projection part, and then comes in contact with the outer circumference face of the rotary plate 124. That is, the operating plate 115 moves to the side of the first and second fixation plates 113 and 114, and the operational contacts a and b sequentially come in contact with the first contact c and the second contact d.

Accordingly, immediately after an application of the initial electric power, the inrush current of a high reverse-electromotive force generated in the primary coil 7*a* of the high voltage transformer HVT is eliminated through the PTC thermistor PTC positioned on one side of the first contact c. Then the second contact d comes in contact-state after the lapse of a given time period, e.g., 20–40 ms due to difference of distance of 2–4 mm between the respective contacts, to thereby prevent any damage to the microwave oven and an overload of each driving circuit.

Further, the normal driving electric power is provided to the microwave oven by the above operations, and the lamp 2, the fan motor 3 and the driving motor 4, which are connected between the first electric power line L1 and the second electric power line L2, are operated. The high voltage transformer HVT also generates high voltage, and this high voltage is supplied to the magnetron MGT through the high voltage capacitor HVC and the high voltage diode HVD. The magnetron MGT is driven to generate a microwave so as to cook the foodstuff placed inside the cooking chamber 41.

Accordingly, with the apparatus for eliminating the inrush current of the microwave oven according to an embodiment of the present invention, there is no need to install a plurality of cost ineffective relays for the electronic type microwave oven, and there is also no need to install cost ineffective relay for eliminating the inrush current for the mechanical type microwave oven. That is, since the switching unit and driving unit according to the present invention may be simply installed to effectively eliminate the inrush current, the assembly and work efficiencies are improved according to a simpler wiring process. Also, the total manufacturing cost for the microwave oven is reduced.

It will be apparent to those skilled in the art that various modifications and variations can be made in the inrush current eliminating) apparatus of the microwave oven of the present invention without deviating from the spirit or scope of the invention. Thus, it is intended that the present invention covers the modifications and variations of this invention provided they come within the scope of the appended claims and their equivalents.

What is claimed is:

1. An apparatus for eliminating inrush current of a microwave oven without use of any manual input, said oven having a high voltage driving module, said module comprising a high voltage transformer, the apparatus comprising:

a switching means for applying electric power to the high voltage driving module upon the switching means being switched on, wherein an operational contact firstly comes in contact with a first contact coupled with a PTC thermistor and secondly with a second contact after a given time period; and a driving means for generating a first driving force to turn on, and a second driving force to turn off, the switching means, said driving force from said driving means being a sole operative means for controlling on-off operation of the switching means.

2. The apparatus of claim 1, wherein the switching means comprises:

a first fixation plate, one end of which is fixed and connected to a first terminal via the PTC thermistor and at the other end of which the first contact is formed;

a second fixation plate, one end of which is fixed and connected to the first terminal and at the other end of which the second contact is formed at a given distance from the first contact; and an operating plate, one end of which is fixed and has a second terminal and at the other end of which an operating contact is formed to be sequentially connected to the first and the second contacts by the driving force of the driving means.

3. The apparatus of claim 2, wherein the driving means comprises a relay operating part for operating the switching means by a magnetic force generated by a control of the microcomputer.

4. The apparatus of claim 3, wherein the relay operating part comprises:

a relay coil for generating the magnetic force due to electric current turned on by the microcomputer; and a push member for pushing the operating plate by being rotated with respect to a hinge by the magnetic force of the relay coil.

5. The apparatus of claim 2, wherein said driving means comprises a cam for operating the switching means by the driving force of a timer motor.

6. The apparatus of claim 5, wherein the cam comprises a rotary plate having a groove at one side thereof, said plate rotated by the driving force of the timer motor, the operating plate having a projection inserted into the groove at an initial position of the timer motor, the projection being pushed by the circumferential side of the rotary plate when the rotary plate is rotated out of the initial position.

7. The apparatus of claim 1, wherein the operational contact is distanced from the second contact, such that the operational contact comes in contact with the first contact and then with the second contact after about 20–40 ms.

8. The apparatus of claim 1, wherein the operational contact and the second contact are distanced 2–4 mm farther than the operational contact is distanced from the first contact.

9. A method for eliminating inrush current of a microwave oven without use of any manual input, said oven having a high voltage driving module, said module comprising a high voltage transformer, the method comprising the steps of:

(1) applying electric power to the high voltage driving module upon the switching means being switched on, wherein an operational contact firstly comes in contact with a first contact coupled with a PTC thermistor and secondly with a second contact after a given time period; and (2) generating a first driving force to turn on, and a second driving force to turn off, the switching means, said driving force from said driving means being a sole operative means for controlling on-off operation of the switching means;

said first and second steps being carried out without manual adjustments.

10. The method of claim 9, wherein the switching means comprises:

a first fixation plate, one end of which is fixed and connected to a first terminal via the PTC thermistor and at the other end of which the first contact is formed;

a second fixation plate, one end of which is fixed and connected to the first terminal and at the other end of which the second contact is formed at a given distance from the first contact; and an operating plate, one end of which is fixed and has a second terminal and at the other end of which an operating contact is formed to be sequentially connected to the first and the second contacts by the driving force of the driving means.

11. The method of claim 10, wherein the driving means comprises a relay operating module for operating the switching means by a magnetic force generated by a control of the microcomputer.

12. The method of claim 11, wherein the relay operating module comprises:

a relay coil for generating the magnetic force due to electric current turned on by the microcomputer; and a push member for pushing the operating plate by being rotated with respect to a hinge by the magnetic force of the relay coil.

13. The method of claim 10, wherein said driving means comprises a cam for operating the switching means by the driving force of a timer motor.

14. The method of claim 13, wherein the cam comprises a rotary plate having a groove at one side thereof, said plate rotated by the driving force of the timer motor, the operating plate having a projection inserted into the groove at an initial position of the timer motor, the projection being pushed by the circumferential side of the rotary plate when the rotary plate is rotated out of the initial position.

15. The method of claim 9, wherein the operational contact is distanced from the second contact, such that the operational contact comes in contact with the first contact and then with the second contact after about 20–40 ms.

16. The method of claim 9, wherein the operational contact and the second contact are distanced 2–4 mm farther than the operational contact is distanced from the first contact.

* * * * *